US005460440A

United States Patent [19]

Moauro

[11] Patent Number: 5,460,440

[45] Date of Patent: Oct. 24, 1995

[54] CLOSET LINER AND GARMENT COVER

[76] Inventor: Violet Moauro, 2216 N. Gate, Riverside, Ill. 60546

[21] Appl. No.: 62,270

[22] Filed: May 17, 1993

[51] Int. Cl.[6] ..... A47F 7/24

[52] U.S. Cl. ..... 312/3; 211/180

[58] Field of Search ..... 312/3–6; 135/904, 135/902, 905, 90, 95, 96, 101, 104, 105–106; 211/180

[56] References Cited

U.S. PATENT DOCUMENTS

| | | | |
|---|---|---|---|
| Re. 15,037 | 2/1921 | Feldman | 312/4 |
| 225,101 | 3/1880 | Brackett | 312/3 |
| 662,014 | 11/1900 | McNamara | 312/3 |
| 1,154,659 | 9/1915 | Schlachter | 312/5 |
| 1,510,583 | 10/1924 | Cooke | 312/4 |
| 1,558,653 | 10/1925 | Trevlieb . | |
| 2,071,088 | 2/1937 | Rottman . | |
| 2,215,695 | 9/1940 | Ginsberg . | |
| 2,236,115 | 3/1941 | Schwartzman . | |
| 2,534,380 | 12/1950 | Scwartzman | 312/3 |
| 2,584,722 | 2/1952 | London . | |
| 3,173,464 | 3/1965 | Curtis . | |
| 3,330,321 | 7/1967 | Wels . | |
| 3,744,624 | 7/1973 | Dunne . | |
| 4,111,309 | 9/1978 | Henry | 211/104 |
| 4,954,384 | 9/1990 | Hartwell . | |

FOREIGN PATENT DOCUMENTS

| | | |
|---|---|---|
| 68795 | 2/1915 | Switzerland . |

*Primary Examiner*—Stephen C. Pellegrino
*Assistant Examiner*—Nancy Mulcare
*Attorney, Agent, or Firm*—Patula & Associates

[57] ABSTRACT

A closet liner and garment cover comprising flexible protective sheeting, preferably transparent plastic, draped over rigid closet member supports. The sheeting is comprised of a plurality of panels, with a central panel being secured to an interior rigid closet member support, then draped over an exterior rigid member support from which the sheeting freely and downwardly depends. Additional sheeting panels are movably adjacent to and in overlapping alignment with the secured panel to provide easy maintenance of the liner and cover, and ready access to closet contents.

19 Claims, 3 Drawing Sheets

CLOSET LINER AND GARMENT COVER

This invention relates to closet liners for protecting closet contents and, in particular, to means for protecting garments stored within conventional closets from dust, dirt, wrinkling and untoward wear and tear.

Background of the Invention

It is recognized that existing inventions and devices provide protective coverings for a variety of articles to be stored. In the area of articles to be stored within closets and the like, the protective covering devices known to date disclose various means for enclosing and or carrying articles such as clothes. One such popular means has been the garment bag. In U.S. Pat. No. 3,744,624 to Dunne, for example, a garment storage bag is disclosed having a top and bottom wall, and side and rear walls formed from a rack or frame supporting a thin flexible material such as plastic. The device is generally rectangular. Hooks are used to hang the device from a closet rod, and a zipper formed along one of the walls avails access to and complete closure of the garment bag. The advantage of this type of garment storage bag is that it is a self-contained unit which can be removed from a closet or hung within a closet or elsewhere to display contents stored within it. A significant disadvantage of this device, however, is that access to the bag's interior can be cumbersome and is obviously limited in size. The steps of unzippering the front wall, pushing away the front wall flaps and trying to store or retrieve garments within the bag as it wriggles about in its hung position makes this invention and like designs difficult to employ for regular storage protection means. This type of unit therefore tends to be utilized more successfully for garments intended to be stored for a longer period, such as seasonal wear, without requiring frequent access.

Another invention similar to U.S. Pat. No. 3,744,624 is U.S. Pat. No. 3,330,321 to Wels. This device is an infant wardrobe enclosing and carrying bag. The inventions are similar in that each is intended to be hung from a support, each is comprised of side walls, an openable slit to access the storage space of the garment bag, and the ability to transport the bag as a self-contained unit, provided it can be hung in order to be used. Again, however, the disadvantages of this type of device include that it can be cumbersome to use, and it requires an independent support from which to hang but is not stable as hung so that retrieval of items from within it can be a clumsy process.

U.S. Pat. Nos. 2,584,722 to London, 2,236,115 to Schwartzman, 2,071,088 to Rottman and 1,558,653 to Treulieb disclose similar types of hanging garment bag inventions. These inventions specifically are intended to provide dust-proof, moth-proof, transportable storage protection to garments stored within the bag. As garment bags, they are designed as only temporary protection and storage means for use apart from regular daily access to garments because such frequent access would be cumbersome and limiting for the user. These types of storage and protection means require zipping and unzipping of the access slit, maneuvering of garments past or through the typically narrow bag opening which can be clumsy and obstructive, and significant instability of the bag as hung which makes the devices difficult to use daily as storage protection means, even though they present other advantages through their transportability.

The present invention is designed to improve upon the inadequacies of currently available garment protection coverings such as garment bags and the like by utilizing means for enhancing an existing conventional closet configuration with protective sheeting. The primary object of the present invention is to protect clothes from dust, dirt and damage using such protective sheeting slipped about or secured to rigid closet members such as shelving or rods.

Another object of the present invention is to provide a closet liner and garment covering that protects the garments while, at the same time, facilitates easy storage and retrieval of them.

Another object of the present invention is to provide a means for improving the protective capabilities of an existing conventional closet with a protective lining and garment cover while minimizing the effects of garment wrinkling by permitting clothes and the like to be hung directly in the closet and also within the protective lining and garment cover.

Yet another object of the present invention is to provide a closet liner and garment cover which allows a wardrobe to remain entirely visible for easy inspection, selection and provides ready access to the closet storage space and garments stored therewithin for frequent use, without requiring special access zippers or sealable closure devices usually dependent upon two hands to operate.

Still another object of the present invention is to provide a lightweight, flexible, yet durable protective covering for articles to be stored within a closet, which device is readily adaptable in size and lay out to closets of varying configuration, thus providing a versatile system for closet lining and garment protection.

These and other objects of the present invention will become apparent from the description of the invention that follows. The spirit and scope of the invention are to be interpreted but not limited by the description of the preferred and alternate embodiments of the invention disclosed below.

BRIEF SUMMARY OF THE INVENTION

The present invention is a closet liner and garment cover comprising flexible protective sheeting formed preferably of transparent plastic, which sheeting is draped around or, in the alternative, secured to rigid closet member supports, and allowed to hang freely from said supports as a covering over garments stored behind or under the sheeting. In the preferred embodiment of the invention, the sheeting is comprised of a plurality of transparent plastic pieces mounted at a first end to a rigid closet member inside support, then draped over a rigid closet member outside support and allowed to hang generally vertically from said outside support over the upper portion of the garment support height and, preferably, approximately two (2) feet downward from said outside support. In the preferred embodiment of the invention, the sheeting is comprised of a plurality of units partially overlapped at adjacent lengths to provide slits for accessing garments hung from a closet rod placed between said inside support and said outside support or to access the storage space behind said sheeting, with the central sheeting portion mounted to the rigid closet member inside support, and non-central sheeting portions movably placed adjacent to and overlapping with the central sheeting portion. In alternate embodiments of the invention, a third rigid closet member apex support is placed above the closet rod from which stored garments are hung to provide additional clearance for the sheeting, particularly immediately above the closet rod set between said inside support and said outside support.

DETAILED DESCRIPTION OF THE INVENTION

The objects of the present invention, its advantages and other aspects will be apparent upon consideration of the following detailed description of the invention. This detailed description is intended to disclose the invention by way of example through preferred embodiments, and is not intended to limit the spirit and scope of the invention.

Figure 1:
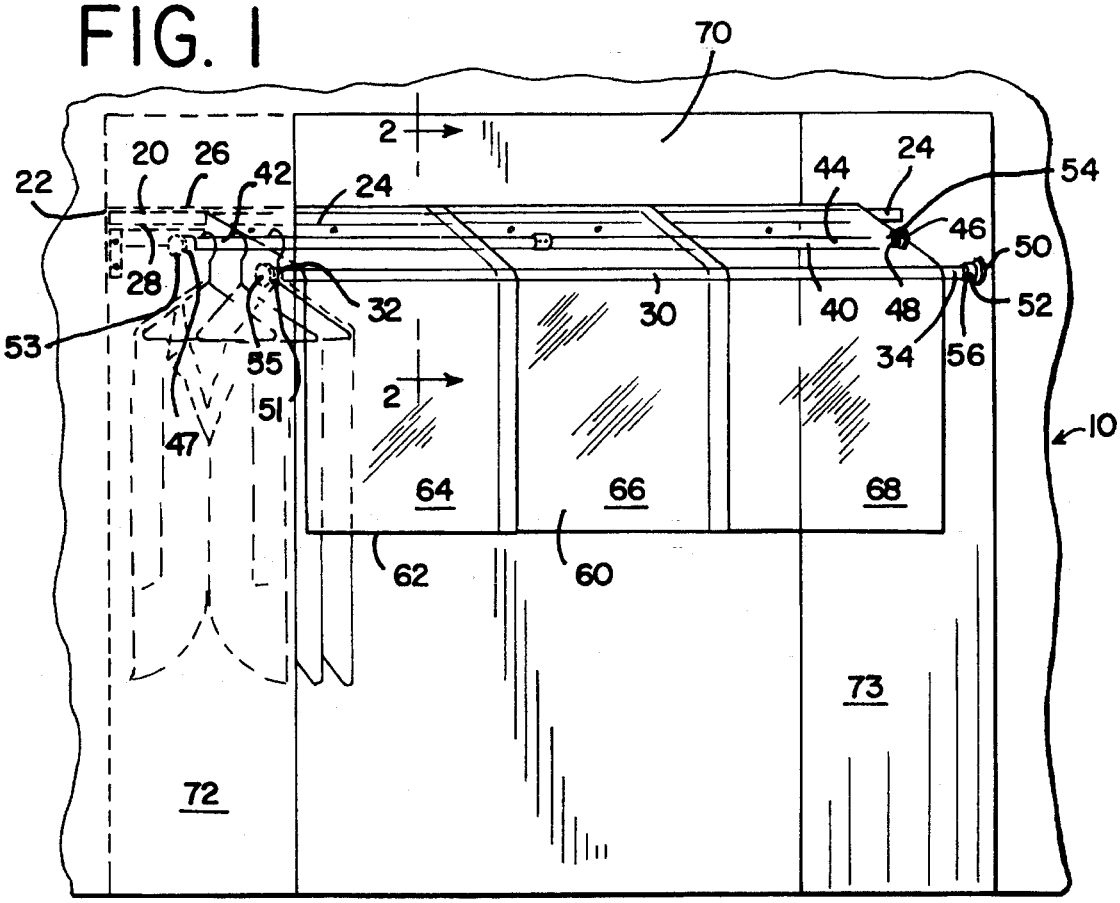
FIG. 1 is a front perspective view of the preferred embodiment of the present invention showing three panels of sheeting mounted to a shelf serving as the interior support.

Referring now to FIG. 1, the closet liner and garment cover system 10 of the present invention is shown in front perspective view as it would be seen from the front of a closet having closet walls consisting of interior closet wall 70, and side closet walls 72 and 73 onto which the system 10 is installed. The system 10 is comprised of an interior support 20. In the preferred embodiment of the invention shown in FIG. 1, the interior support 20 is a conventional shelf having an inside edge 22, an outside edge 24, a top shelf face 26 and a bottom shelf face 28. The system 10 is further comprised of an exterior support 30 which, in the preferred embodiment, is rod-shaped, said exterior support 30 having support ends 32 and 34. Support ends 32 and 34 cooperatively associate with support mount means 50 which is comprised of a first wall bracket 52 and a second wall bracket 51 into which support ends 32 and 34 fit to affix support 30 in place as secured to side closet walls 72 and 73 at exterior support mount sites 55 and 56, respectively.

FIG. 1 further shows the system 10 of the present invention as including a garment support 40 being generally rod-shaped and having bracket ends 42 and 44. Said bracket ends 42 and 44 cooperatively associate with support mount means 46 which is comprised of a first wall bracket 47 and a second wall bracket 48 into which bracket ends 42 and 44 fit to affix garment support 40 in place as secured to side closet walls 72 and 73 at exterior support mount sites 53 and 54, respectively.

FIG. 1 further defines the system 10 by depicting the sheeting 60 having an inside edge 61 and an outside edge 62. In the preferred embodiment of the invention shown, sheeting 60 is comprised of a plurality of panels 64, 66 and 68. Inside edge 61 of the sheeting 60 is affixed to the inside edge 22 of interior support 20. In the alternative, as shown more clearly in FIG. 2, inside edge 61 of sheeting 60 is affixed to the interior closet wall 70 using sheeting mount tack 74 or other conventional adhesive or fastener means to affix sheeting 60 in place at said interior support 20. Sheeting 60 then is draped over top shelf face 26, over garment support 40 and over exterior support 30 from which it depends downwardly.

Figure 2:
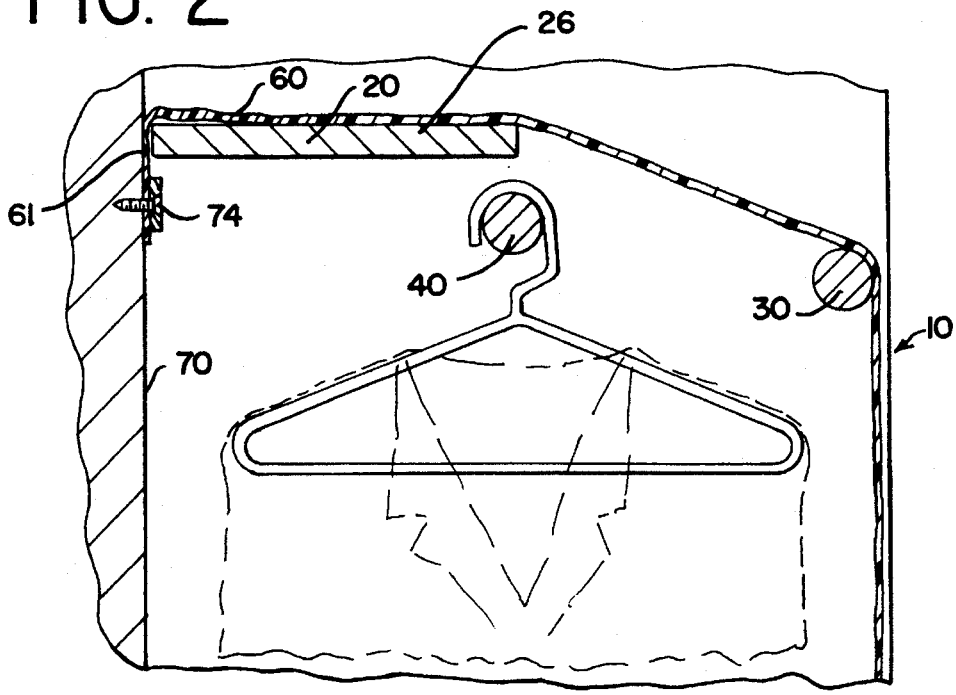
FIG. 2 is a partial side elevational view of the present invention taken along line 2—2 of FIG. 1.
Figure 3:
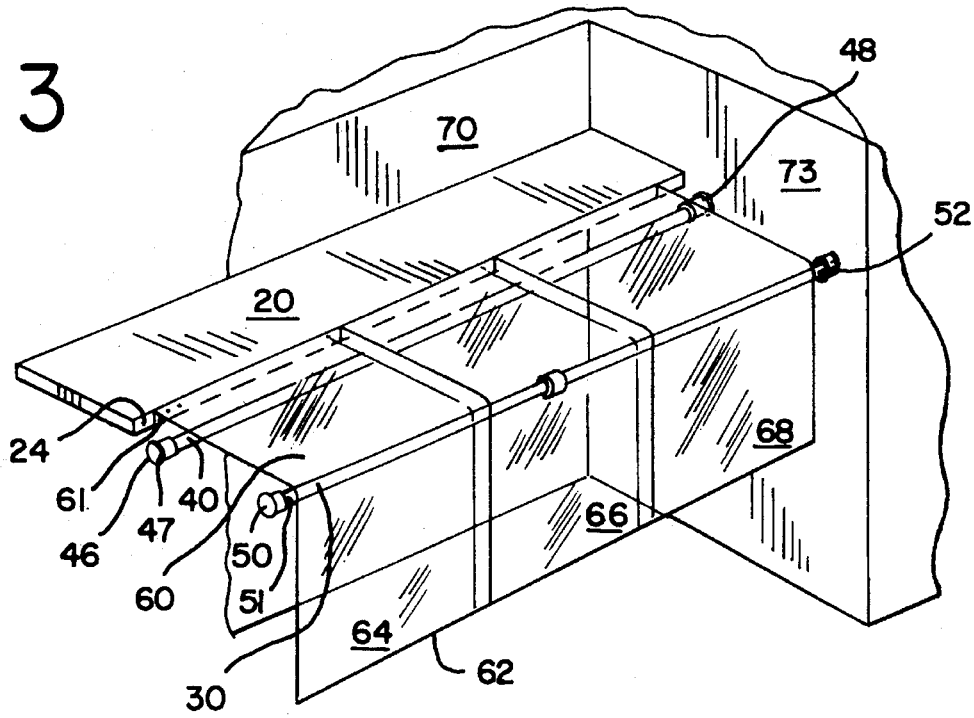
FIG. 3 is a front perspective view of an alternate embodiment of the present invention showing the sheeting affixed to the exterior edge of the shelf serving as the interior support.

FIG. 3 depicts an alternate preferred embodiment of the present invention in which the inside edge 61 of sheeting 60 is affixed to outside edge 24 of interior support 20. Sheeting 60 then is draped over garment support rod 40 and exterior support 30 in a manner similar to that depicted in FIGS. 1 and 2, with sheeting 60 depended downwardly from exterior support 30.

Figure 4:
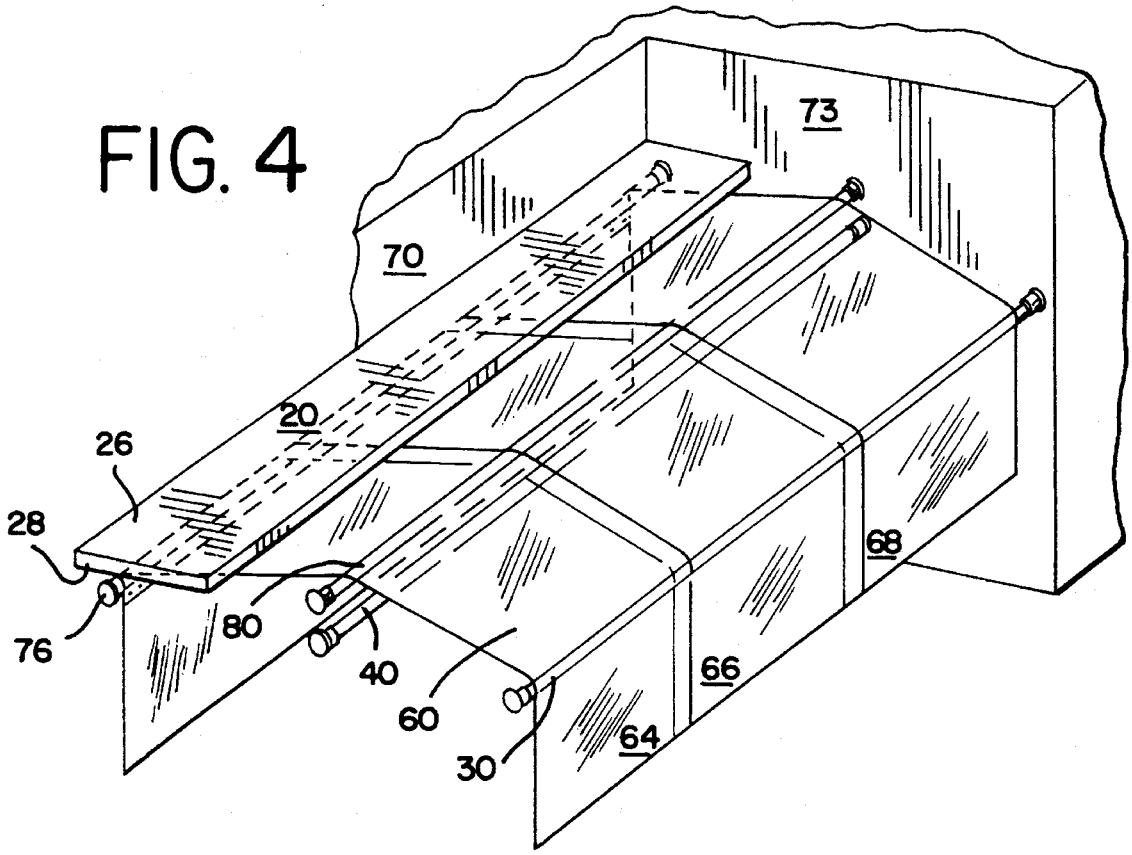
FIG. 4 is a front perspective view of another alternate embodiment of the present invention showing a rod serving as the interior support under the closet shelf shown and further depicting an apex rod mounted between the shelf and the exterior support to provide additional garment hanging clearance.

FIG. 4 depicts a third preferred embodiment of the present invention in which the inside edge 61 of sheeting 60 is affixed to or about sheeting mount member 76 mounted along interior closet wall 70. Sheeting 60 then is drawn outward away from said interior closet wall 70 but under said interior support 20 along bottom shelf face 28, then draped over apex rod 80 mounted to side closet walls 72 and 73 in a position that provides clearance for accessing said garment support rod 40, then draped over said exterior support rod 30 and downwardly therefrom.

Figure 5:
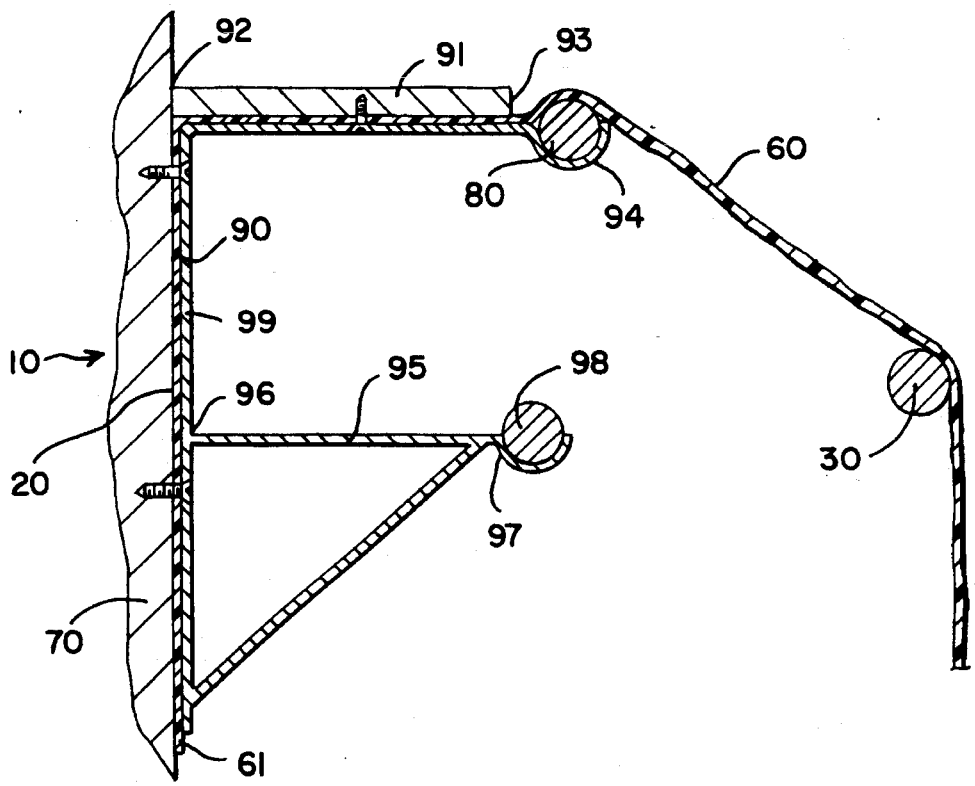
FIG. 5 is a front perspective view of still another alternate embodiment of the present invention showing a combination shelf-bracket-rod as the mount means for the rod garment supports and protective sheeting.

FIG. 5 shows a fourth preferred embodiment of the present invention in which a bracket mount 90 is utilized to combine the features of interior support 20 and support mount means 46 and 50 shown in FIGS. 1 and 2. Bracket mount 90 is comprised of top shelf 91 having inside edge 92 and outside edge 93 to which outside edge 93 is affixed apex rod support 94. Bracket mount 90 is further defined by vertical face 99 which depends generally perpendicularly downward from said top shelf 91, and garment rod shelf 95 having inside edge 96 and outside edge 97 to which garment rod support 98 is affixed. As shown in FIG. 5, inside edge 61 of sheeting 60 is draped over bracket mount 90 which is then secured to interior closet wall 70 by conventional means. Sheeting 60 then is further secured to said top shelf 91 also by conventional means such as by screw-type fasteners. Sheeting 60 then is drawn outward away from said interior closet wall 70 and draped over apex rod 80 supported within apex rod support 94, then draped over said exterior support rod 30 and downwardly therefrom.

In FIGS. 1–5, the panels 64, 66 and 68 overlap each other partially but not sealably to enhance access to the storage space covered by the system 10. In each of these preferred embodiments, panel 66 is fixed to a stationary support such as interior closet wall as shown in FIGS. 1 and 2, interior support 20 as shown in FIG. 3, sheeting mount rod 76 as shown in FIG. 4 or top shelf 91 of bracket mount 90 as shown in FIG. 5. Panels 64 and 68 remain movable in these preferred embodiments to facilitate dusting, cleaning and overall access to closet contents.

Figure 6:
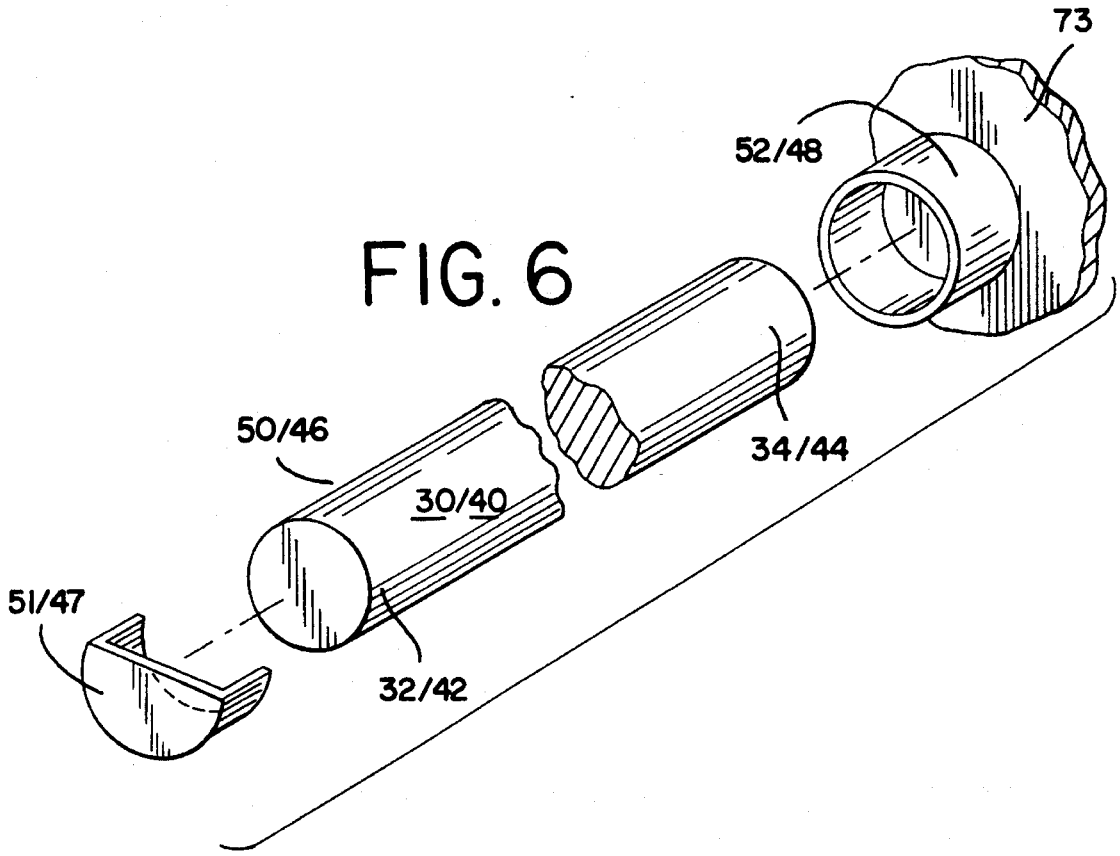
FIG. 6 is a partial perspective view of the wall mount means showing a rod support and a bracket to be mounted to a closet wall to which bracket the rod support attaches.

FIG. 6 is a perspective view of support mount means 50 showing first wall bracket 51 to be mounted to side closet wall 72, and exterior support rod 30, having support ends 32 and 34, with support end 32 cooperatively associating with wall bracket 51 to be inserted therewithin, and with support end 34 cooperatively associating with wall bracket 52 in identical fashion, although not shown, wall bracket 52 being mounted to side closet wall 73. Thus support mount means 50 is comprised of two wall brackets 51 and 52, one each to be mounted to side closet wall 72 and 73 respectively, with the exterior support rod 30 horizontally supported thereby as depicted in FIGS. 1–4.

Because support mount means 46 is identical to support mount means 50, FIG. 6 also depicts the support mount means 46, except that support mount means 46 supports garment support rod 40, and support mount means 50 supports exterior support 30. Therefore, support mount means 46, having a first wall bracket 47 and a second wall bracket 48 each secured to side closet walls 72 and 73, respectively, supports garment support rod 40 by inserting rod bracket ends 42 and 44, respectively, into wall brackets 47 and 48, thereby horizontally supporting garment support rod 40 within the closet. Apex rod 80 is supported similarly by support mount means, as shown in FIG. 4.

The foregoing is only illustrative of the principles of the invention and its preferred embodiments. Since numerous modifications and changes will be readily apparent to those skilled in the art, the foregoing illustrations and descriptions are not intended to limit the invention to the exact construction and operation shown and described but, rather, to include all suitable modifications and equivalents of the invention shown and described and falling within the scope of the invention as claimed.

I claim:

1. A device for covering garments comprising in combination:

a closet having at least one rear wall, two side walls, and an interior.;

rigid support means for supporting fixedly secured to the interior of said closet and having an interior support having an inside edge mounted to said rear wall of said closet, said interior support being further mounted between said side walls of said closet, said interior support being further defined by an outside edge, a top face and a bottom face, said support means being further defined by an exterior support mounted to said side walls at a closet side wall height lower than said interior support and away from said rear wall;

protective sheeting fixedly secured to said rear wall of said interior support, draped over said top face of said interior support and over said exterior support to provide protective covered space for closet contents;

a garment support fixedly secured to said side walls of said closet in parallel alignment with said interior support between said interior support and said exterior support and at a closet height lower than said interior support; and mount means for securing said exterior support and said garment support to said closet side walls wherein said garment support is a rod-shaped member fixedly secured to said side walls of said closet, said exterior support is a rod-shaped member, and said mount means are independent brackets adapted to removably receive said garment support and said exterior support.

2. The device recited in claim 1, wherein said protective sheeting is comprised of at least three panels, including a central panel and two end panels, said panels having an inside edge fixedly secured to said outside edge of said interior support, said panels further having an outside edge passed over said exterior support, and draped downwardly from said exterior support, with said end panels placed adjacent to and overlapping with said central panel.

3. The device recited in claim 1, wherein said protective sheeting is comprised of at least three panels, including a central panel and two end panels, said panels having an inside edge fixedly secured to said outside edge of said interior support, said panels further having an outside edge passed over said exterior support, and draped downwardly from said exterior support, with said end panels placed adjacent to and overlapping with said central panel, said panels being formed of transparent, flexible, waterproof material.

4. A device for covering garments comprising in combination:

a closet having at least one rear wall, two side walls, and an interior;

rigid support means for supporting fixedly secured to the interior of said closet and having an interior support having inside edge mounted to said rear wall of said closet, said interior support being further mounted between said side walls of said closet, said interior support being further defined by an outside edge, a top face and a bottom face, said support means being further defined by an exterior support mounted to said side walls at a closet side wall height lower than said interior support and away from said rear wall;

protective sheeting fixedly secured to said rear wall of said interior support, draped over said top face of said interior support and over said exterior support to provide protective covered space for closet contents;

a garment support fixedly secured to said side walls of said closet in parallel alignment with said interior support between said interior support and said exterior support and at a closet height lower than said interior support; and mount means for securing said exterior support and said garment support to said closet side walls wherein said support means is further defined by a sheeting mount member affixed to said side walls of said closet under said interior support near said rear wall of said closet, and an apex rod mounted to said side walls of said closet at a closet height greater than that of said interior support, said device being further defined by said protective sheeting having at least three panels, including a central panel and two end panels, said panels having an inside edge fixedly secured to or about said sheeting mount member, said panels further having an outside edge passed under said interior support, over said apex rod and over said exterior support, and then draped downwardly from said exterior support, with said end panels placed adjacent to and overlapping with said central panel.

5. The device recited in claim 4, wherein said panels are formed of transparent, flexible, waterproof material.

6. A device for covering garments stored within a closet having an interior, at least one rear wall, and two side walls, said device comprising:

a rigid support means for supporting objects and capable of being fixedly secured to the interior of said closet and said support having an interior support defined by a top shelf having an inside edge and an outside edge, and an apex rod affixed to said outside edge of said top shelf, a vertical face depended generally perpendicularly downward from said top shelf coplanar for coplanar alignment with said rear wall of said closet, a garment rod shelf having an inside edge and an outside edge, and a garment rod support affixed to said outside edge of said garment rod shelf, said rigid support means being further defined by an exterior support for mounting to said side walls at height lower than said interior support and away from said rear wall;

protective sheeting having an inside edge capable of being fixedly secured to said rear wall of said closet between said rear wall and said interior support, and an outside edge drawn under said top shelf, over said apex rod, and over said exterior support to provide protective covered space for closet contents.

7. The device recited in claim 6, wherein said protective sheeting is comprised of a plurality of panels formed of transparent, flexible, waterproof material.

8. The device recited in claim 6, wherein said protective sheeting is comprised of at least three panels, including a central panel and two end panels, said panels having an inside edge, with said inside edge of said central panel said inside edge capable of being fixedly secured to said closet between said rear wall and said vertical face of said interior support, said panels further having an outside edge drawn away from said rear wall, beyond said interior support and said exterior support, and draped downwardly from said exterior support, with said end panels movably placed adjacent to and overlapping with said central panel.

9. A method for providing a closet liner and garment cover by mounting said liner and cover within a closet having at least a rear wall and two side walls, comprising the steps of:

draping flexible sheeting over a first rigid support;

mounting said first rigid support to said rear wall of said closet;

mounting a second rigid support to said side walls below said first rigid support;

mounting a third rigid support to said side walls;

passing said sheeting over said second rigid support draping said sheeting over said third rigid support from which said sheeting then hangs generally vertically.

10. A method for providing a closet liner and garment cover by mounting said liner and cover within a closet having at least a rear wall and two side walls, comprising the steps affixing flexible sheeting to a first-rigid support mounted within said closet near said rear wall;

mounting a second rigid support to said side walls below said first rigid support;

mounting a third rigid support to said side walls;

passing said sheeting over said second rigid support draping said sheeting over said third rigid support and hanging said sheeting generally vertically and downward from said third rigid support.

11. The method recited in claim 10, wherein said flexible sheeting is comprised of a plurality of panels including a central panel and two end panels, with said step of affixing said sheeting to said first rigid support further comprising the step of affixing said central panel to said first rigid support, followed by the step of placing said end panels adjacent to and overlapping with said central panel.

12. A system for covering garments housed in a closet, said system comprising:

protective sheeting having first and second edges means for securing said first edge to a first surface of said closet;

intermediate support means for supporting said protective sheeting between said first and second edges;

means for mounting said intermediate support means on a second and third surface of said closet;

said intermediate support means being displaced from said means for securing and parallel to said first surface of said closet so as to support said protective sheeting above said garments and such that said second edge hangs freely wherein said intermediate support means supports said garments.

13. The system of claim 12, wherein said protective sheeting is comprised of a plurality panels.

14. The system of claim 13, wherein said panels overlap one another.

15. The system of claim 13, wherein said panels are formed of a transparent, flexible, waterproof material.

16. A device for covering garments comprising in combination:

a closet having a rear wall, two side walls and a planar interior support affixed to said rear wall and said side walls and extending substantially perpendicular therefrom;

protective sheeting having first and second edges, said first edge being fastened between said interior support and said rear wall;

intermediate support means for supporting said protective sheeting at a point between said first and second edges, said intermediate support means mounted on said side walls at a distance from said interior support;

a garment support secured to said side walls in parallel alignment with said interior support;

said protective sheeting extending over said interior support and over said intermediate support means and said second edge hanging freely from said intermediate support means.

17. The device of claim 16, wherein said protective sheeting is comprised of a plurality of panels.

18. The device of claim 16, wherein said protective sheeting is comprised of at least three panels, including a central panel and two end panels movably placed adjacent to and overlapping said central panel.

19. The device of claim 16, wherein said protective sheeting is formed of transparent, flexible, waterproof material.

* * * * *